US007223685B2

(12) United States Patent
Andryushchenko et al.

(10) Patent No.: US 7,223,685 B2
(45) Date of Patent: May 29, 2007

(54) DAMASCENE FABRICATION WITH ELECTROCHEMICAL LAYER REMOVAL

(75) Inventors: Tatyana N. Andryushchenko, Portland, OR (US); Anne E. Miller, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/602,488

(22) Filed: Jun. 23, 2003

(65) Prior Publication Data

US 2005/0003637 A1 Jan. 6, 2005

(51) Int. Cl.
*H01L 21/4763* (2006.01)
*H01L 21/44* (2006.01)
*H01L 21/461* (2006.01)
*H01L 21/302* (2006.01)

(52) U.S. Cl. ..... 438/622; 438/625; 438/626; 438/627; 438/628; 438/629; 438/631; 438/633; 438/634; 438/637; 438/638; 438/643; 438/644; 438/645; 438/648; 438/652; 438/653; 438/654; 438/656; 438/669; 438/672; 438/685; 438/687; 438/691; 438/692; 257/E21.01; 257/E21.011

(58) Field of Classification Search ..... 438/678–679, 438/627, 656, 648, 685–686, 687, 637–638, 438/622, 625–629, 631, 633–634, 643–645, 438/652–654, 669, 672, 691–692, 695, 697, 438/700

See application file for complete search history.

(56) References Cited

U.S. PATENT DOCUMENTS 5,227,041 A 7/1993 Brogden et al.
5,807,165 A 9/1998 Uzoh et al.
6,117,770 A * 9/2000 Pramanick et al. ..... 438/659
6,121,152 A * 9/2000 Adams et al. ..... 438/697
6,176,992 B1 * 1/2001 Talieh ..... 205/87
6,383,917 B1 * 5/2002 Cox ..... 438/637
6,395,152 B1 * 5/2002 Wang ..... 204/224 M
6,495,443 B1 * 12/2002 Lopatin et al. ..... 438/618
6,638,863 B2 * 10/2003 Wang et al. ..... 438/690
6,653,229 B2 * 11/2003 Cox ..... 438/637
6,739,953 B1 * 5/2004 Berman et al. ..... 451/41
6,764,713 B2 * 7/2004 Wytman ..... 427/123
6,780,772 B2 * 8/2004 Uzoh et al. ..... 438/690

(Continued)

*Primary Examiner*—Michael Lebentritt
*Assistant Examiner*—Mohsen Ahmadi
(74) *Attorney, Agent, or Firm*—Blakely, Sokoloff, Taylor & Zafman LLP

(57) ABSTRACT

The present application discloses process comprising providing a wafer, the wafer comprising an inter-layer dielectric (ILD) having a feature therein, an under-layer deposited on the ILD, and a barrier layer deposited on the under-layer, and a conductive layer deposited in the feature, placing the wafer in an electrolyte, such that at least the barrier layer is immersed in the electrolyte, and applying an electrical potential between the electrode and the wafer. Also disclosed is an apparatus comprising a vessel having an electrolyte therein, a first electrode at least partially immersed in the electrolyte, the first electrode comprising a wafer comprising an inter-layer dielectric (ILD) having a feature therein, an under-layer deposited on the ILD layer, a barrier layer deposited on the under-layer and a conductive layer deposited in the feature, a second electrode at least partially immersed in the electrolyte, and a potential source for applying a potential difference between the first and second electrodes. Other embodiments are also disclosed and claimed.

33 Claims, 3 Drawing Sheets

U.S. PATENT DOCUMENTS

2002/0074238 A1* 6/2002 Mayer et al. ..... 205/660
2002/0096778 A1* 7/2002 Cox ..... 257/774
2002/0115283 A1* 8/2002 Ho et al. ..... 438/633
2002/0175419 A1* 11/2002 Wang et al. ..... 257/774
2003/0139053 A1* 7/2003 Uzoh et al. ..... 438/697
2003/0207558 A1* 11/2003 Bao et al. ..... 438/622
2004/0067640 A1* 4/2004 Hsu et al. ..... 438/637
2004/0072423 A1* 4/2004 Jorne et al. ..... 438/687
2004/0253809 A1* 12/2004 Yao et al. ..... 438/631

* cited by examiner

DAMASCENE FABRICATION WITH ELECTROCHEMICAL LAYER REMOVAL

TECHNICAL FIELD

The present invention relates generally to semiconductor wafer processing and in particular, but not exclusively, to electrochemical removal of barrier layers from low-k dielectric layers in semiconductor wafers.

BACKGROUND

Semiconductor devices usually include a large number of features or components—such as transistors, switches and conductive lines—built on an underlying substrate or wafer. The components are usually built by successively depositing layers of different materials on the substrate and then etching and/or selectively removing all or part of the deposited layers. The deposited layers are of different materials depending on the component, but can include metals, metal alloys, pure semiconductors, doped semiconductors, and dielectrics.

Certain semiconductor devices include a variety of conducting paths or interconnects between components of the device. These interconnects are often built by etching a feature such as a trench into a dielectric layer, and then depositing an adhesion layer, a barrier layer and, finally a conductive layer onto the dielectric layer. To complete the interconnect, the conductive layer, barrier layer and adhesion layer must be removed from the regions of the dielectric layer surrounding the feature (also known as the "field"), leaving the trench filled with a conductive layer, usually metal, separated from the dielectric layer by the barrier layer and the adhesion layer.

The method of choice for removing conductive and barrier layers from a semiconductor wafer has been chemical mechanical polishing (CMP). In CMP, a mildly abrasive slurry is poured onto a polishing pad, and the wafer surface is then pressed onto the slurry with a force calculated to exert a certain pressure on the surface of the wafer. The polishing pad and the surface of the wafer move against each other causing the abrasive slurry to grind away the conductive or barrier layers on the surface of the wafer. Despite its prevalence, however, CMP has some important disadvantages. CMP is inherently expensive because it uses substantial amounts of consumables that cannot be re-used, such as polishing pads and abrasive slurry. Because CMP involves polishing the surface of a wafer by the exertion of a mechanical shear stress on the surface of the wafer, CMP can easily damage structures on the wafer. When metal and barrier layers are used on a wafer to form a structure in a dielectric material with a low dielectric constant (also known as a low-k dielectric), CMP has the potential for large amounts of damage. Low-k dielectrics have correspondingly low material properties, such as Young's modulus, hardness, toughness, etc, meaning that mechanical stresses can be particularly damaging. Since damage to even a small number of structures on a wafer can render the entire wafer useless, use of CMP, particularly with low-k dielectrics, can substantially lower the yield and raise the expense.

There have been attempts to use a hybrid method that combines CMP with electrochemical removal of layers from a wafer, but these attempts have not had satisfactory results. Because the hybrid method continues to rely on mechanical forces, it carries with it all the disadvantages of CMP methods. When metal and barrier layers are used on a wafer to form a structure in a dielectric material, electrochemical removal has yielded poor results. Traditional barrier materials are very resistant, meaning that they require very high applied potentials for removal. Moreover, traditional barrier materials have been difficult to remove without also removing the metal layer; in other words, existing electrochemical approaches are not selective enough to the barrier materials used.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Embodiments of an apparatus and method for electrochemical removal of layers in semiconductor wafers are described herein. In the following description, numerous specific details are described to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in this specification do not necessarily all refer to the same embodiment. Furthermore, the particular features, structures, or characteristics may be combined in any suitable manner in one or more embodiments.

Figure 1A:
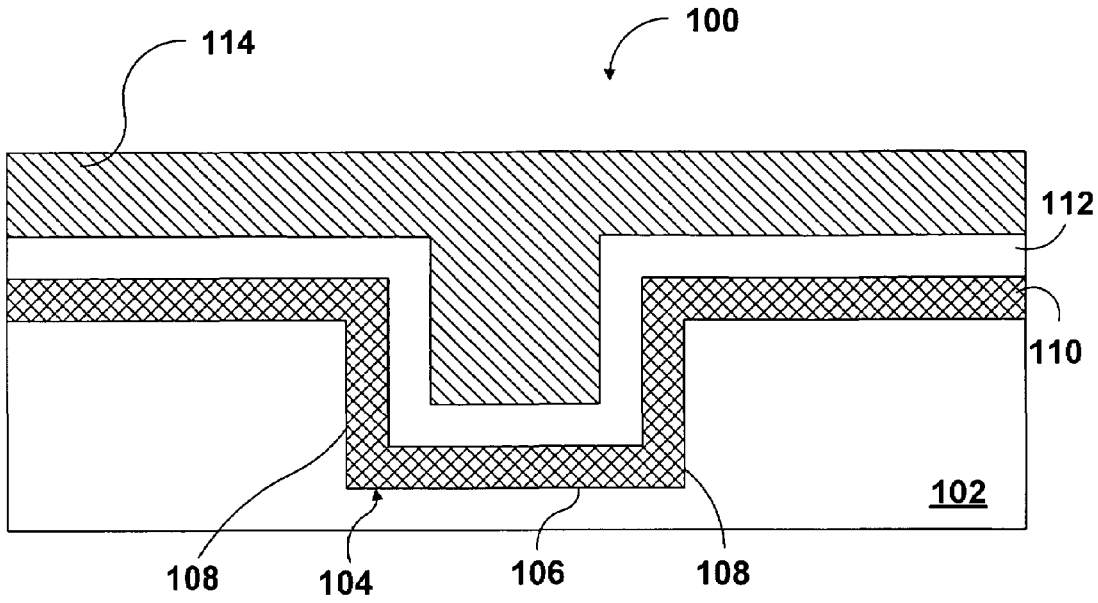
FIGS. 1A–1D are cross-sectional views of a portion of a wafer illustrating an embodiment of the process for forming a feature such as an interconnect.

FIGS. 1A–1D together illustrate an embodiment of an inventive process for creating a feature in a semiconductor device. FIG. 1A illustrates a portion of a semiconductor wafer 100 comprising an inter-layer dielectric (ILD) layer 102 having a feature 104 etched therein. The ILD 102 itself will not usually exist in isolation as shown, but will instead be layered on some other portion of the wafer not shown in the figure. In the embodiment shown, the feature 104 is a trench that can be used to form an interconnect between other components (not shown) on the wafer, but in other embodiments the feature may be something different. The feature 104 includes a bottom 106 and a pair of sidewalls 108. On the ILD 102, as well as on the bottom and sidewalls of the feature 104, are layered an under-layer 110 and a barrier layer 112. A conductive layer 114 is deposited on the barrier layer with sufficient thickness that it fills the feature 104, as well as projecting above the level of the surrounding layers.

The feature 104 is created in the ILD layer 102 using ordinary masking and etching processes known in the art. The ILD layer 102 can comprise any type of dielectric, although a dielectric having a low dielectric constant k (i.e., a low-k dielectric) is preferred to reduce ill effects from cross-capacitance that occurs, for example, between neighboring interconnects.

After the feature 104 is created in the ILD layer, the under-layer 110 is deposited on the surface of the ILD, such that it coats the bottom 106 and sidewalls 108 of the feature 104, as well as the field surrounding the feature on the wafer. The under-layer 110 promotes adhesion and serves as a conductive layer for electro-dissolution of the barrier layer 112. In various embodiments, the under-layer comprises materials such as titanium (Ti), titanium nitride (TiN), tungsten (W), tungsten nitride (WN) or tantalum nitride (TaN), although other materials are possible in other embodiments. The under-layer can be applied to the ILD layer using chemical vapor deposition (CVD), physical vapor deposition (PVD), or atomic layer deposition (ALD). In a preferred embodiment, the under-layer is deposited using PVD to provide a thicker conductive layer on the ILD surface while providing a thinner layer on the bottom 106 and sidewalls 108 of the feature 104.

Following the deposition of the under-layer 110, a barrier layer 112 is deposited on the under-layer. The barrier layer should preferably be conductive enough to allow electropolishing of the conductive layer 114, and so that it lowers the electrical resistance and requires less applied potential difference. In various embodiments the barrier layer 112 can comprise ruthenium (Ru), rhodium (Rh), tantalum (Ta), iridium (Ir), osmium (Os), or alloys thereof containing nitrogen (N), silicon (Si) or carbon (C). As with the under-layer 110, the barrier layer can be deposited using CVD, PVD or ALD.

Finally, following deposition of the barrier layer 112 an electrically conductive layer 114 is formed on the barrier layer 112 using conventional processes such as CVD, PVD or ALD. The deposition of the conductive layer is customarily followed by electroplating to fill the feature 104, or at least those portions of the feature not already filled with the under-layer and barrier layer, with conductive material as shown. In the illustrated embodiment the conductive material used for the conductive layer is preferably copper (Cu), although other conductive materials may be suitable in other embodiments.

Figure 1B:
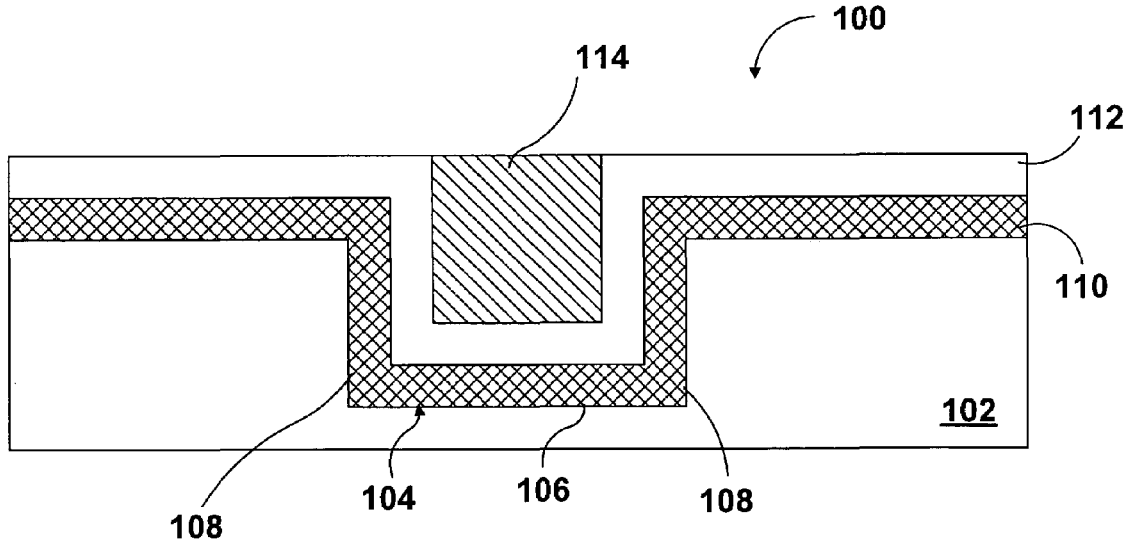

FIG. 1B illustrates the state of the wafer after the conductive layer 114 is removed. Starting with the wafer as shown in FIG. 1A, the conductive layer 114 is removed from the field using electro-polish, chemical polishing or CMP. At the conclusion of the removal of the conductive layer, conductive material remains inside the feature 104, separated from the ILD layer 102 by the under-layer 110 and the barrier layer 112. The portion of the conductive layer that previously covered the field surrounding the feature is substantially removed, leaving only the under-layer 110 and the barrier layer 112 in the field.

Figure 1C:
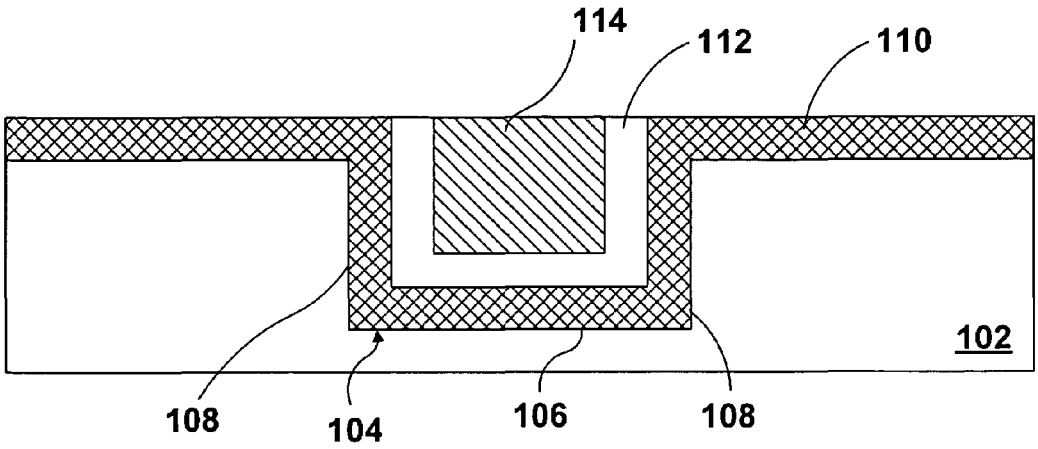

FIG. 1C illustrates the wafer 100 following removal of the barrier layer 112 from parts of the feature and from the surrounding field. Starting with the wafer as shown in FIG. 1B, the barrier layer 112 is electrochemically dissolved by immersing the wafer, or at least the barrier layer portion of the wafer, in an electrolyte under potentiostatic control and applying a potential difference (i.e., a voltage) having a specific value relative to a standard reference electrode, such as a saturated calomel electrode (SCE) which is 0.242V more positive than standard hydrogen electrode (SHE). In one embodiment, the voltage can have a value greater than or equal to 0.5V relative to the SCE. In one embodiment, the electrolyte in which the wafer or its relevant portions are immersed should include a base and have a pH equal to or greater than 11. Suitable bases to be included in the electrolyte include solutions of potassium hydroxide (KOH), sodium hydroxide (NaOH), ammonium hydroxide ($NH_4OH$) or tetra-methyl ammonium hydroxide (TMAH). At the conclusion of the removal of the barrier layer from the field, conductive material 114 remains inside the feature 104, separated from the ILD layer by the under-layer 110 and the barrier layer 112. Portions of the barrier layer that previously covered the field outside the feature are removed, leaving only the under-layer 110 covering the ILD layer 102 in the field surrounding the feature. It is the presence of this conductive under-layer 110 that enables the complete electrochemical removal of the barrier 112.

Figure 1D:
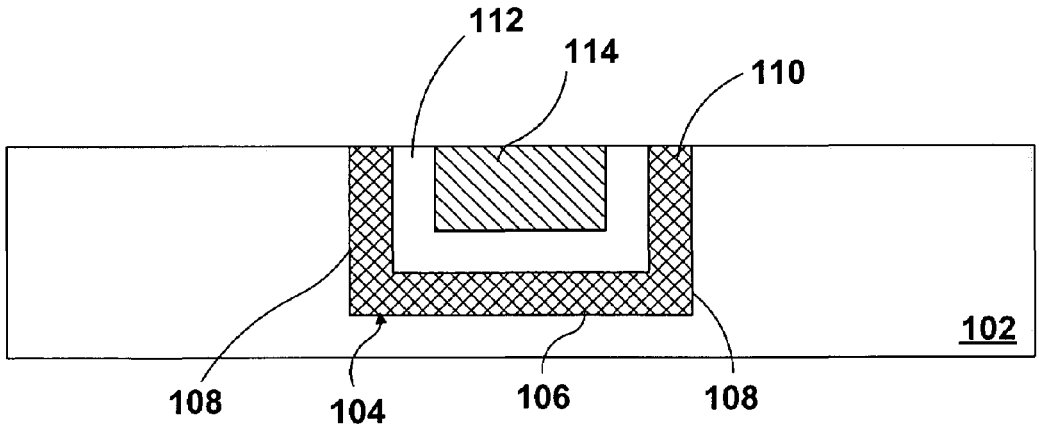

FIG. 1D illustrates the wafer 100 following the removal of the under-layer 110 shown in FIG. 1C from the field surrounding the feature. Starting with the wafer as shown in FIG. 1C, in one embodiment the under layer 110 is removed by selective etching in a solution selective to copper and dielectric, such as a buffered hydrofluoric acid (HF) or hydrogen peroxide ($H_2O_2$)-based solution. In an alternative embodiment, the under-layer can be removed by polishing using CMP with a polishing slurry at a low pressure (e.g., less than 1.5 psi) and with a soft polishing pad so that the under-layer can be removed without damaging the underlying ILD layer 102. For the reasons explained above, a gentle way of removing the under-layer 110 is particularly important where the ILD layer comprises a low-k dielectric. At the conclusion of the removal of the barrier layer from the field, conductive material 114 remains inside the feature 104, separated from the ILD layer 102 by the under-layer 110 and the barrier layer 112. All layers that previously covered the field surrounding the feature are removed, leaving the ILD layer 102 exposed in the field.

Figure 2:
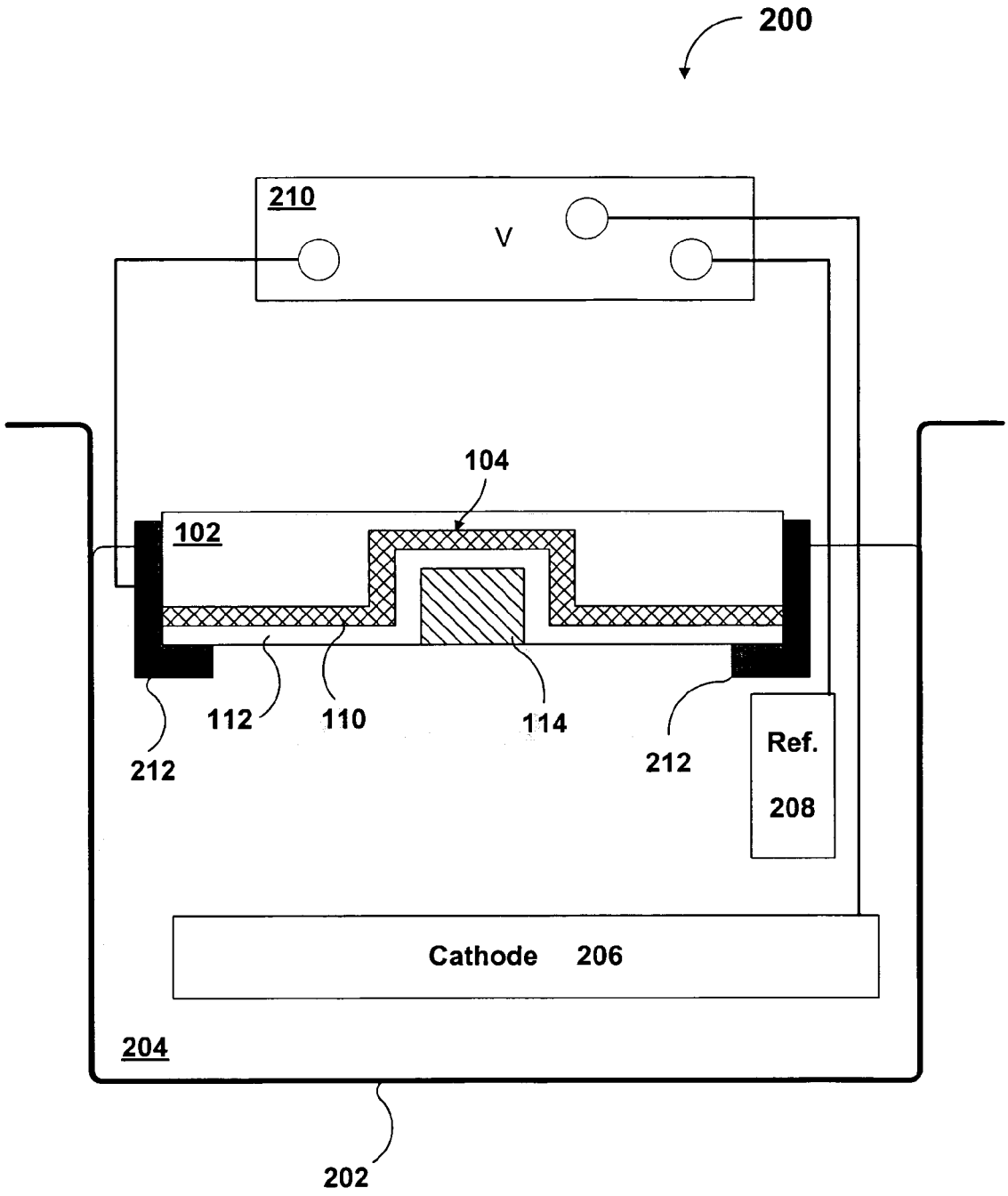
FIG. 2 is a schematic of an embodiment of an electrochemical cell used in connection with the process illustrated in FIGS. 1A–1D.

FIG. 2 illustrates schematically an embodiment of an apparatus for electrochemically removing layers from a wafer, as discussed above in connection with FIGS. 1A–1D. The apparatus is an electrolysis cell 200 comprising a vessel 202 within which is placed an electrolyte 204. Several electrodes are at least partially immersed in the electrolyte; the electrodes include a cathode 206, an anode comprising the wafer 100, and a reference electrode 208. All the electrodes are electrically connected to a potential source 210, which applies a potential difference (i.e., a voltage) to the electrodes.

Although the illustrated embodiment shows the vessel 202 as a beaker, in other embodiments the vessel 202 can be any kind of vessel or container capable of holding a fluid; the exact size, shape and construction of the vessel will be determined by operational requirements, such as the number of wafers to be simultaneously processed and the sizes and shapes of the individual wafers.

In one embodiment of the electrolysis cell 200, the electrolyte 204 includes a base and has a pH equal to or greater than 10. Suitable bases for the electrolyte include solutions of potassium hydroxide (KOH), sodium hydroxide (NaOH), ammonium hydroxide ($NH_4OH$) or tetra-methyl ammonium hydroxide (TMAH). In alternative embodiments, certain additives can be included in the electrolyte to accomplish specific purposes. Oxidizers such as hydrogen peroxide ($H_2O_2$) can be added to the electrolyte to increase the rate of electrochemical dissolution. Corrosion inhibitors such as benzotriazole can be added to protect the copper that will be left behind in the feature from corrosion due to electrolysis. Surfactants such as TRITON-X®, manufactured by the Dow Chemical Company, can be added to increase the selectivity of the electrolysis and to protect the conductive layer. Buffers such as potassium carbonate ($K_2CO_3$) can be added to control the pH of the electrolyte. Finally, complexors such as potassium citrate can be added to enhance dissolution in the electrolyte. A limited number of embodiments of the additives are illustrated in Table 1; additional or different additives are, of course, possible within the scope of the invention.

TABLE 1

| Electrolyte Additive | Examples | Example Concentration Range |
|---|---|---|
| Oxidizer | Hydrogen Peroxide ($H_2O_2$). | 0–0.15 M |
| Corrosion Inhibitor | Benzotriazole (BTA). | $10^{-4}$–$10^{-1}$ M |
| Surfactant | Polypropylethylene (PPE); Polypropylene glycol (PPG); Triton-X ®; Polyoxyethylene(POE); Cetyl-trimethyl ammonium hydroxide (CTAOH); Glycolic acid ethyl lauryl ether (GAELE). | $10^{-5}$–$10^{-3}$ M |
| Buffer | Potassium carbonate ($K_2CO_3$); Potassium bicarbonate ($KHCO_2$). | $10^{-3}$–$10^{-1}$ M |
| Complexor | Potassium Citrate, Potassium Oxalate. | $10^{-3}$–$10^{-1}$ M |

The anode comprises the wafer 100, which in the state shown in FIG. 1B, with the conductive layer 114 substantially removed from the field as explained above. With the conductive layer 114 removed, the wafer 100 includes an inter-layer dielectric (ILD) layer 102 having a feature 104 etched therein. On the ILD 102, as well as on the bottom and sidewalls of the feature 104, are layered an under-layer 110 and a barrier layer 112. The remains of the conductive layer 114 fill the feature 104 and are separated from the ILD layer 102 by the under-layer 110 and the barrier layer 112. The wafer 100 is positioned within a holder 212 before insertion into the electrolyte. Among other things, the holder 212 ensures that only the surface of the wafer is exposed to the electrolyte and prevents interactions between the layer interface around the edges of the wafer. The electrolytic cell 200 will be used to gently remove the barrier layer 112 without simultaneously removing the conductive material 114 from inside the feature 104. The wafer 100 is wholly or partially immersed in the electrolyte 204, such that at least the layers to be electrochemically removed from the wafer are immersed in the electrolyte.

The electrode 206 forms the cathode or counter electrode, whilst the wafer 100 forms the anode, which in this case is the working electrode. In addition to the wafer (anode) and the cathode 206, a reference electrode 208, which in one embodiment is a saturated calomel electrode, is also at least partially immersed in the electrolyte 204.

All three electrodes—the wafer (anode) 100, the cathode 206 and the reference electrode 208—are electrically connected to a potential source 210, which applies an electrical potential difference to the electrodes to cause electrolysis to occur. The potential source can be any kind of source capable of applying a voltage having a specific value with respect to a reference electrode, such as the SCE. In one embodiment, the voltage can have a value greater than or equal to 0.5V relative to the SCE. The source may be as simple as a common battery, although in most applications a potential source whose potential difference is steady and accurately controlled is preferred.

In operation of the electrolysis cell 200, a potential difference is applied between the wafer 100 and the cathode 206, causing the electrolytic removal of the barrier layer 112 to begin. As the electrolysis proceeds, the barrier layer 112 of the wafer (see FIG. 1C) is electrochemically dissolved from the wafer into the electrolyte 204. When the required amount of barrier layer has been removed, the potential difference between the cathode 206 and the wafer 100 is removed, causing the electrolytic removal of the barrier layer 112 to cease. As described above, electrolytic removal of the barrier can be combined with other approaches for removing other layers from the wafer 100. In one embodiment, for example, the conductive layer 114 can first be removed by CMP or electropolish, the barrier layer can be removed electrolytically, and the under-layer can then be removed very gently using CMP.

The above descriptions of embodiments of the invention and the description in the Abstract below are not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description.

The terms used in the following claims should not be construed to limit the invention to the specific embodiments disclosed in the specification and the claims. Rather, the scope of the invention is to be determined entirely by the following claims, which are to be interpreted in accordance with established doctrines of claim interpretation.

The invention claimed is:

1. A process comprising:

providing a wafer comprising an inter-layer dielectric (ILD) having a feature therein, an under-layer deposited on the ILD, a barrier layer deposited on the under-layer and a conductive layer deposited on the barrier layer;

exposing the barrier layer;

immersing the wafer in an electrolyte, such that at least the baffler layer is wholly immersed in the electrolyte;

applying an electrical potential between the wafer and an electrode immersed in the electrolyte until the under-layer is exposed in the field surrounding the feature; and removing the under-layer from the field surrounding the feature using selective etching or gentle chemical-mechanical polishing.

2. The process of claim 1 wherein the conductive layer is copper.

3. The process of claim 1 wherein the baffler layer comprises ruthenium (Ru), rhodium (Rh), tantalum (Ta), iridium (Ir), osmium (Os), or alloys thereof containing nitrogen (N), silicon (Si) or carbon (C).

4. The process of claim 1 wherein the under-layer is titanium (Ti), titanium nitride (TiN), tungsten (W), tungsten nitride (WN) or tantalum nitride (TaN).

5. The process of claim 1, further comprising removing at least a portion of the under-layer using chemical mechanical polishing (CMP).

6. The process of claim 1 wherein the electrolyte has a pH equal to or greater than 10.

7. The process of claim 6 wherein the electrolyte comprises a solution of potassium hydroxide (KOH), sodium hydroxide (NaOH), ammonium hydroxide ($NH_4OH$) or tetra-methyl ammonium hydroxide (TMAH).

8. The process of claim 1, further comprising adding an additive to the electrolyte.

9. The process of claim 8 wherein the additive is an oxidizer, a corrosion inhibitor, a surfactant, a buffer, a complexor, or combinations thereof.

10. The process of claim 1 wherein the electrical potential has a value equal to or greater than 0.5V with respect to the saturated calomel reference electrode.

11. The process of claim 1, further comprising removing at least a portion of the conductive layer using chemical mechanical polishing (CMP).

12. A process comprising:

providing a wafer comprising an inter-layer dielectric (ILD) having a feature therein, an under-layer deposited on the ILD, and a baffler layer deposited on the under-layer, and a conductive layer deposited in the feature;

immersing the wafer in an electrolyte, such that at least the barrier layer is wholly immersed in the electrolyte;

applying an electrical potential between the wafer and an electrode immersed in the electrolyte until the under-layer is exposed in the field surrounding the feature; and removing the under-layer from the field surrounding the feature using selective etching or gentle chemical-mechanical polishing.

13. The process of claim 12 wherein the conductive layer is copper.

14. The process of claim 12 wherein the baffler layer comprises ruthenium (Ru), rhodium (Rh), tantalum (Ta), iridium (Ir), osmium (Os), or alloys thereof containing nitrogen (N), silicon (Si) or carbon (C).

15. The process of claim 12 wherein the under-layer is titanium (Ti), titanium nitride (TiN), tungsten (W), tungsten nitride (WN) or tantalum nitride (TaN).

16. The process of claim 12, further comprising removing at least a portion of the under-layer using chemical mechanical polishing (CMP).

17. The process of claim 12 wherein the electrolyte has a pH equal to or greater than 10.

18. The process of claim 17 wherein the electrolyte comprises a solution of potassium hydroxide (KOH), sodium hydroxide (NaOH), ammonium hydroxide ($NH_4OH$) or tetra-methyl ammonium hydroxide (TMAH).

19. The process of claim 12, further comprising adding an additive to the electrolyte.

20. The process of claim 19 wherein the additive is an oxidizer, a corrosion inhibitor, a surfactant, a buffer, a complexor, or combinations thereof.

21. The process of claim 12 wherein the electrical potential has a value equal to or greater than 0.5V with respect to the saturated calomel reference electrode.

22. The process of claim 12, further comprising removing at least a portion of the conductive layer using chemical mechanical polishing (CMP).

23. A process comprising:

providing a wafer comprising an inter-layer dielectric (ILD) having a feature therein, an under-layer deposited on the ILD, a barrier layer deposited on the under-layer and a conductive layer deposited on the barrier layer;

exposing the barrier layer;

placing the wafer in a holder that seals the edges thereof, such that, when the holder and the wafer are immersed in an electrolyte, the electrolyte will only affect a surface of the wafer;

immersing the holder and the wafer in the electrolyte, such that at least the barrier layer is wholly immersed in the electrolyte; exposing the under-layer in the field surrounding the feature by electrolytically removing the barrier layer from the field surrounding the feature; and removing the under-layer from the field surrounding the feature using selective etching or gentle chemical-mechanical polishing.

24. The process of claim 23 wherein the conductive layer is copper.

25. The process of claim 23 wherein the barrier layer comprises ruthenium (Ru), rhodium (Rh), tantalum (Ta), iridium (Ir), osmium (Os), or alloys thereof containing nitrogen (N), silicon (Si) or carbon (C).

26. The process of claim 23 wherein the under-layer is titanium (Ti), titanium nitride (TiN), tungsten (W), tungsten nitride (WN) or tantalum nitride (TaN).

27. The process of claim 23, further comprising removing at least a portion of the under-layer using chemical mechanical polishing (CMP).

28. The process of claim 23 wherein the electrolyte has a pH equal to or greater than 10.

29. The process of claim 28 wherein the electrolyte comprises a solution of potassium hydroxide (KOH), sodium hydroxide (NaOH), ammonium hydroxide ($NH_4OH$) or tetra-methyl ammonium hydroxide (TMAH).

30. The process of claim 23, further comprising adding an additive to the electrolyte.

31. The process of claim 30 wherein the additive is an oxidizer, a corrosion inhibitor, a surfactant, a buffer, a complexor, or combinations thereof.

32. The process of claim 23 wherein the electrical potential has a value equal to or greater than 0.5V with respect to the saturated calomel reference electrode.

33. The process of claim 23, further comprising removing at least a portion of the conductive layer using chemical mechanical polishing (CMP).

* * * * *